US009388976B2

(12) United States Patent
Tilmont et al.

(10) Patent No.: US 9,388,976 B2
(45) Date of Patent: Jul. 12, 2016

(54) HIGH PRESSURE COMBUSTOR WITH HOT SURFACE IGNITION

(71) Applicant: Orbital ATK, Inc., Dulles, VA (US)

(72) Inventors: Daniel Tilmont, Rocky Point, NY (US); Joseph A. Alifano, Commack, NY (US); Akiva A. Sklar, Kew Gardens, NY (US); Nicholas Tiliakos, Huntington Station, NY (US); Vincenzo Verrelli, Floral Park, NY (US)

(73) Assignee: Orbital ATK, Inc., Dulles, VA (US)

( * ) Notice: Subject to any disclaimer, the term of this patent is extended or adjusted under 35 U.S.C. 154(b) by 303 days.

(21) Appl. No.: 13/782,865

(22) Filed: Mar. 1, 2013

(65) Prior Publication Data

US 2013/0344448 A1 Dec. 26, 2013

Related U.S. Application Data

(60) Provisional application No. 61/664,015, filed on Jun. 25, 2012.

(51) Int. Cl.
*F22B 1/18* (2006.01)
*E21B 36/02* (2006.01)
(Continued)

(52) U.S. Cl.
CPC ..... *F22B 1/1853* (2013.01); *E21B 36/02* (2013.01); *E21B 43/122* (2013.01); *E21B 43/24* (2013.01);
(Continued)

(58) Field of Classification Search
CPC ..... F23D 2207/00; F23R 3/04; F23R 3/343; E21B 43/122; F22B 27/02; F22B 27/12; F22B 1/1853
See application file for complete search history.

(56) References Cited

U.S. PATENT DOCUMENTS 2,707,029 A 4/1955 Van Hartesveldt
2,803,305 A 8/1957 Behning et al.
(Continued)

FOREIGN PATENT DOCUMENTS

EP 2 199 538 A2 6/2010
GB 2 287 312 A 9/1995
(Continued)

OTHER PUBLICATIONS

International Search Report for Application No. PCT/US2013/047272 mailed Oct. 7, 2013.
(Continued)

*Primary Examiner* — Steven B McAllister
*Assistant Examiner* — Rabeeul Zuberi
(74) *Attorney, Agent, or Firm* — TraskBritt

(57) ABSTRACT

A combustor including a housing, an injector body, insulation, an air/fuel premix injector, a hot surface igniter, a fuel injector and a burner. The housing forms a main combustion chamber. The injector body is coupled within the housing and the injector body includes an initial combustion chamber. The insulation lines the initial combustion chamber. The air/fuel premix injector is configured and arranged to dispense a flow of air/fuel mixture into the initial combustion chamber. The hot surface igniter is configured and arranged to heat up and ignite the air/fuel mixture in the initial combustion chamber. The fuel injector dispenses a flow of fuel and the burner dispenses a flow of air. The flow of fuel from the fuel injector and the flow of air from the burner are ignited in the main combustion chamber by the ignition of the air/fuel mixture in the initial combustion chamber.

14 Claims, 3 Drawing Sheets

(51) Int. Cl.

| | |
|---|---|
| ***E21B 43/243*** | (2006.01) |
| ***E21B 43/263*** | (2006.01) |
| ***F23D 14/02*** | (2006.01) |
| ***F23D 14/70*** | (2006.01) |
| ***F23Q 7/00*** | (2006.01) |
| ***E21B 43/12*** | (2006.01) |
| ***E21B 43/24*** | (2006.01) |
| ***E21B 43/26*** | (2006.01) |
| ***F23R 3/34*** | (2006.01) |
| ***F22B 27/02*** | (2006.01) |
| ***F22B 27/12*** | (2006.01) |

(52) U.S. Cl.

CPC ..... *E21B 43/243* (2013.01); *E21B 43/26* (2013.01); *E21B 43/263* (2013.01); *F22B 27/02* (2013.01); *F22B 27/12* (2013.01); *F23D 14/02* (2013.01); *F23D 14/70* (2013.01); *F23Q 7/00* (2013.01); *F23R 3/343* (2013.01); *Y10T 137/0329* (2015.04)

(56) References Cited

U.S. PATENT DOCUMENTS

| | | | | |
|---|---|---|---|---|
| 3,223,539 | A * | 12/1965 | Hyde et al. | 501/124 |
| 3,284,137 | A | 11/1966 | Wolber | |
| 3,456,721 | A | 7/1969 | Smith | |
| 3,482,630 | A | 12/1969 | Earlougher, Jr. | |
| 3,522,995 | A | 8/1970 | Erickson | |
| 3,674,093 | A | 7/1972 | Reese | |
| 4,205,725 | A | 6/1980 | Howard et al. | |
| 4,237,973 | A | 12/1980 | Todd | |
| 4,243,098 | A | 1/1981 | Meeks et al. | |
| 4,336,839 | A | 6/1982 | Wagner et al. | |
| 4,377,205 | A | 3/1983 | Retallick | |
| 4,380,265 | A | 4/1983 | Mohaupt | |
| 4,380,267 | A | 4/1983 | Fox | |
| 4,385,661 | A | 5/1983 | Fox | |
| 4,390,062 | A | 6/1983 | Fox | |
| 4,397,356 | A | 8/1983 | Retallick | |
| 4,411,618 | A | 10/1983 | Donaldson et al. | |
| 4,421,163 | A | 12/1983 | Tuttle | |
| 4,431,069 | A | 2/1984 | Dickinson, III et al. | |
| 4,442,898 | A | 4/1984 | Wyatt | |
| 4,458,756 | A | 7/1984 | Clark | |
| 4,463,803 | A | 8/1984 | Wyatt | |
| 4,471,839 | A | 9/1984 | Snavely et al. | |
| 4,498,531 | A | 2/1985 | Vrolyk | |
| 4,522,263 | A | 6/1985 | Hopkins et al. | |
| 4,558,743 | A | 12/1985 | Ryan et al. | |
| 4,648,835 | A | 3/1987 | Eisenhawer et al. | |
| 4,682,471 | A | 7/1987 | Wagner | |
| 4,699,213 | A | 10/1987 | Fleming | |
| 4,718,489 | A | 1/1988 | Hallam et al. | |
| 4,783,585 | A | 11/1988 | Meshekow | |
| 4,805,698 | A | 2/1989 | Baugh et al. | |
| 4,834,174 | A | 5/1989 | Vandevier | |
| 4,895,206 | A | 1/1990 | Price | |
| 5,052,482 | A | 10/1991 | Gondouin | |
| 5,211,230 | A | 5/1993 | Ostapovich et al. | |
| 5,339,897 | A | 8/1994 | Leaute | |
| 5,525,044 | A | 6/1996 | Chen | |
| 5,623,576 | A | 4/1997 | Deans | |
| 5,623,819 | A | 4/1997 | Bowker et al. | |
| 5,775,426 | A | 7/1998 | Snider et al. | |
| 5,802,854 | A * | 9/1998 | Maeda et al. | 60/737 |
| 6,289,874 | B1 * | 9/2001 | Keefover | 123/399 |
| 6,959,760 | B1 | 11/2005 | Braithwaite et al. | |
| 7,493,952 | B2 | 2/2009 | Ayasse | |
| 7,497,253 | B2 | 3/2009 | Retallick et al. | |
| 7,628,204 | B2 | 12/2009 | Iqbal et al. | |
| 7,640,987 | B2 | 1/2010 | Kalman et al. | |
| 7,665,525 | B2 | 2/2010 | Pfefferle | |
| 7,712,528 | B2 | 5/2010 | Langdon et al. | |
| 7,784,533 | B1 | 8/2010 | Hill | |
| 7,946,342 | B1 | 5/2011 | Robertson | |
| 8,091,625 | B2 | 1/2012 | Ware et al. | |
| 2007/0284107 | A1 | 12/2007 | Crichlow | |
| 2008/0017381 | A1 | 1/2008 | Baiton | |
| 2008/0087427 | A1 | 4/2008 | Kaminsky et al. | |
| 2009/0260811 | A1 | 10/2009 | Cui et al. | |
| 2009/0288827 | A1 | 11/2009 | Coskuner | |
| 2010/0181069 | A1 | 7/2010 | Schneider et al. | |
| 2010/0224370 | A1 | 9/2010 | Donnelly et al. | |
| 2011/0000666 | A1 | 1/2011 | Couto | |
| 2011/0120710 | A1 | 5/2011 | Dong et al. | |
| 2011/0127036 | A1 | 6/2011 | Tilmont et al. | |
| 2011/0227349 | A1 | 9/2011 | Huber et al. | |
| 2011/0297374 | A1 | 12/2011 | Kuhlman et al. | |
| 2013/0161007 | A1 | 6/2013 | Wolfe et al. | |

FOREIGN PATENT DOCUMENTS

| | | |
|---|---|---|
| WO | WO 2006/063200 A2 | 6/2006 |
| WO | WO 2011/103190 A1 | 8/2011 |

OTHER PUBLICATIONS

Blogspot.com, Centrifugal Pump/Deep Well Pump/Sump Pump [online], Aug. 1, 2008, [retrieved on Nov. 26, 2013]. Retrieved from the internet <http://pump-detail.blogspot.com/2008_08_01_archive.html>, 14 pages.

International Preliminary Report on Patentability for Application No. PCT/US2013/047272 dated Dec. 31, 2014, eight (8) pages.

International Written Opinion for Application No. PCT/US2013/047272 dated Dec. 25, 2014, seven (7) pages.

* cited by examiner

HIGH PRESSURE COMBUSTOR WITH HOT SURFACE IGNITION

CROSS-REFERENCE TO RELATED APPLICATION

This Application claims priority to U.S. Provisional Patent Application Ser. No. 61/664,015, titled "APPARATUSES AND METHODS IMPLEMENTING A DOWNHOLE COMBUSTOR," filed on Jun. 25, 2012, which is incorporated in its entirety herein by this reference.

BACKGROUND

Ignition at high pressure, such as that seen in oilfield downhole applications, has proven to be difficult. At pressures above 600 psi, traditional ignition methods such as spark ignition ceases to be viable. Thus, the industry has turned to other ignition sources such as pyrophoric fuels and hot surface ignition. Pyrophoric fuels ignite upon mixing with an oxidizer, such as air or oxygen, which contributes to their high success rate. However, they can leave traces of foreign object debris inside a combustor and adjacent systems, which can cause failures. Pyrophoric fuels are typically very hazardous to store and transport, expensive to supply, and can even be carcinogenic. Therefore, pyrophorics are usually considered as a secondary source for ignition, and their elimination from downhole systems would be desirable. On the other hand, hot surface ignition has none of the chemical or cost drawbacks associated with pyrophorics, rather, the challenge is to utilize the limited power available downhole to raise and keep the temperature of the oxidizer (air) and gaseous hydrocarbon mixture above auto-ignition temperature.

For the reasons stated above and for other reasons stated below, which will become apparent to those skilled in the art upon reading and understanding the present specification, there is a need in the art for an effective and efficient combustion system.

BRIEF SUMMARY

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, a combustor is provided. The combustor includes a housing, an injector body, insulation, an air/fuel premix injector, a hot surface igniter, a fuel injector and a burner. The housing forms a main combustion chamber. The injector body is coupled within the housing, and the injector body includes an initial combustion chamber. The initial combustion chamber is deliberately lined with the insulation. The air/fuel premix injector assembly is configured and arranged to dispense a flow of an air/fuel mixture into the initial combustion chamber. The hot surface igniter is configured and arranged to heat up and ignite the air/fuel mixture in the initial combustion chamber. The fuel injector is configured and arranged to dispense a flow of fuel. The burner is configured and arranged to dispense a flow of air. The flow of fuel from the fuel injector and the flow of air from the burner are ignited in the main combustion chamber by the ignition of the air/fuel mixture in the initial combustion chamber.

In another embodiment, another combustor is provided. This combustor also includes a housing, an injector body, insulation, an air/fuel premix injector, at least one glow plug, a fuel injector plate and a burner. The housing forms a main combustion chamber. The injector body is coupled within the housing. The injector body includes an initial combustion chamber. The insulation lines the initial combustion chamber. The air/fuel premix injector assembly is configured and arranged to dispense a flow of an air/fuel mixture into the initial combustion chamber. The at least one glow plug is configured and arranged to heat up and ignite the air/fuel mixture in the initial combustion chamber. The fuel injector plate is coupled within the injector body a select distance from the air/fuel premix injector. The fuel injector plate is positioned to divert a portion of the flow of the air/fuel mixture from the air/fuel premix injector into the initial combustion chamber. The burner is configured and arranged to dispense a flow of air. The flow of fuel from the injector plate and the flow of air from the burner are ignited in the main combustion chamber by the ignition of the air/fuel mixture in the initial combustion chamber.

In another embodiment, still another combustor is provided. The combustor includes a housing, an injector body, insulation, an air/fuel premix injector assembly, at least one glow plug, a fuel injector plate, a swirl plate burner and a jet extender. The housing forms a main combustion chamber. The injector body is coupled within the housing. The injector body includes an initial combustion chamber. The insulation lines the initial combustion chamber. The air/fuel premix injector assembly is configured and arranged to dispense a flow of air/fuel mixture into the initial combustion chamber. The at least one glow plug is configured and arranged to heat up and ignite the air/fuel mixture in the initial combustion chamber. The fuel injector plate is coupled within the injector body a select distance from the air/fuel premix injector. The fuel injector plate is positioned to divert a portion of the flow of air/fuel mixture from the air/fuel premix injector into the initial combustion chamber. The fuel injector plate has an injector plate central opening. The swirl plate burner is coupled around an outer surface of the injector body. The swirl plate burner is configured and arranged to dispense a flow of air. The flow of fuel from the injector plate and the flow of air from the swirl plate burner are ignited in the main combustion chamber by the ignition of the air/fuel mixture in the initial combustion chamber. A jet extender, generally tubular in shape, extends from the fuel injector central opening of the fuel injector plate into the main combustion chamber.

BRIEF DESCRIPTION OF THE DRAWINGS

The present invention can be more easily understood and further advantages and uses thereof will be more readily apparent when considered in view of the detailed description and the following figures, in which.

In accordance with common practice, the various described features are not drawn to scale but are drawn to emphasize specific features relevant to the present invention. Reference characters denote like elements throughout figures and text.

DETAILED DESCRIPTION

Figure 1:
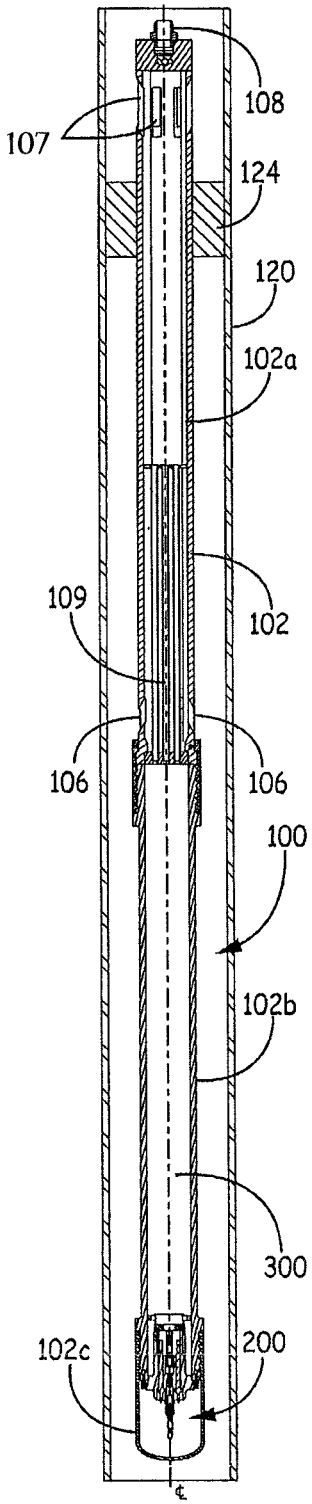
FIG. 1 is a side cross-sectional view of a downhole combustion assembly in one embodiment of the present invention.

In the following detailed description, reference is made to the accompanying drawings, which form a part hereof and in which is shown by way of illustration, specific embodiments in which the inventions may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

Embodiments provide a combustor 200 for a downhole application. In embodiments, the combustor 200 takes separate air and fuel flows and mixes them into a single premix air/fuel stream. The premix air/fuel flow is injected into the combustor 200. As described below, the combustor 200 includes an initial ignition chamber 240 (secondary chamber) and a main combustion chamber 300. The momentum from an air/fuel premix injector 214 stirs the ignition chamber 240 at extremely low velocities relative to the total flow of air and fuel through the combustor 200. Diffusion and mixing caused by a stirring effect changes the initial mixture within the ignition chamber 240 (oxidizer and/or fuel) to a premixed combustible flow. The premixed combustible flow is then ignited by a hot surface igniter, such as, but not limited to, one or more glow plugs 230*a* and 230*b*. Chamber walls lined with insulation 220 limit heat loss therein, helping to raise the temperature of the premixed gases. Once the gases reach the auto-ignition temperature, an ignition occurs. The ignition acts as a pulse, sending a deflagration wave into the main combustion chamber 300 of the combustor 200 therein igniting a main flow field. Once this is accomplished, the one or more glow plugs 230*a* and 230*b* are turned off and the initial ignition chamber 240 no longer sustains combustion. One benefit to this system is that only a relatively small amount of power (around 300 Watts) is needed to heat up the glow plugs 230*a* and 230*b* to a steady state. The main combustion chamber 300 and the initial combustor chamber 240 are configured, such that when the main combustion chamber 300 is operated in the stoichiometric lean range, i.e., equivalence ratio less than 0.5, the initial combustion chamber 240 is being operated in the "near stoichiometric" range, i.e., equivalence ratios varying from 0.5 to 2.0. When the main combustion chamber 300 is operated in the "near stoichiometric" range, i.e., equivalence ratios varying from 0.5 to 2.0, the initial combustion chamber 240 is being operated in the stoichiometric rich range, i.e., equivalence ratio greater than 2.0.

Figure 3B:
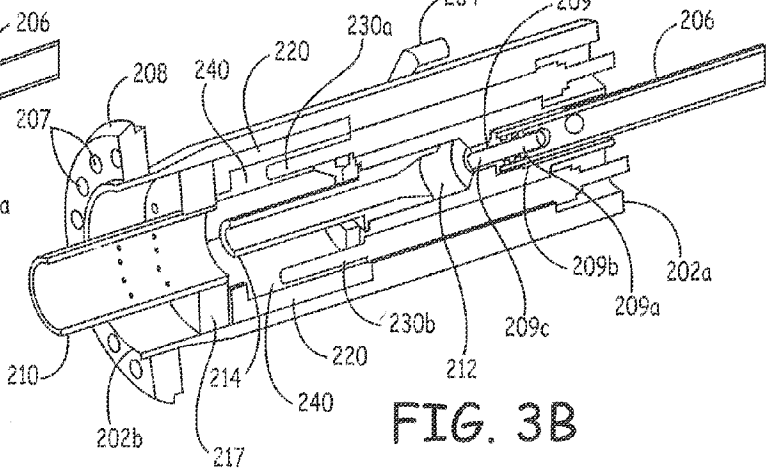
FIG. 3B is a cross-sectional view along line 3B-3B of the combustor of FIG. 2.
Figure 3A:
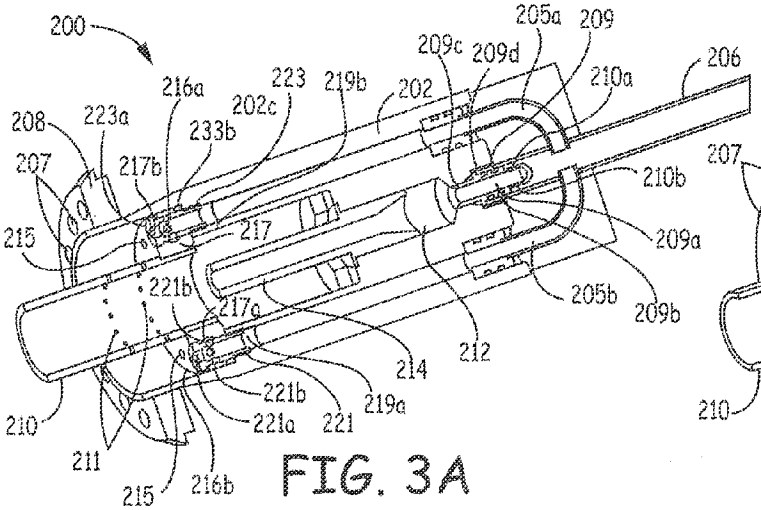
FIG. 3A is a cross-sectional view along line 3A-3A of the combustor of FIG. 2.

Referring to FIG. 1, a cross-sectional side view of a downhole combustion assembly 100 of one embodiment is illustrated. In this example, an embodiment of the downhole combustion assembly 100 is positioned within a casing 120 of a wellbore that has been drilled through the earth to an oil reservoir. An embodiment of a combustion assembly is further discussed in commonly assigned patent application having U.S. patent application Ser. No. 13/745,196, titled "Downhole Combustor," filed on Jan. 22, 2013, which is incorporated herein in its entirety. The downhole combustion assembly 100 of FIG. 1 includes a housing 102. The housing 102 includes a first housing portion 102*a*, a second housing portion 102*b*, and a third housing portion 102*c*. A plurality of delivery connectors 108 (although only one is shown) is coupled to the housing 102. The delivery connectors 108 provide a delivery port to the housing 102 for gases such as air and fuel as well as a connection to deliver power to the glow plugs 230*a* and 230*b*, as illustrated in FIGS. 3A and 3B. Passages (not shown) in the housing 102 deliver the gases and power to the combustor 200, which is received in the third housing portion 102*c*. In this example of the downhole combustor assembly 100, the first housing portion 102*a* includes oil inlet ports 106 that are configured and arranged to receive oil from an oil reserve. A heat exchange system 109, in this embodiment, in the first housing portion 102*a* heats up the oil received in the oil inlet ports 106. Gas and exhaust fumes from the main combustion chamber 300 are expelled through oil and exhaust outlet ports 107 in a top side of the first housing portion 102*a*. Positioned between the oil inlet ports 106 and the oil and exhaust outlet ports 107 is a packing seal 124 that causes oil from the oil reservoir to pass through the housing 102 via the oil input ports 106 and the oil and exhaust outlet ports 107. As discussed above, gases are combusted in the main combustion chamber 300 in the second housing portion 102*b* via combustor 200. Exhaust from the main combustion chamber 300 is passed through the heat exchange system 109 into the oil entering into the oil inlet ports 106.

Figure 2:
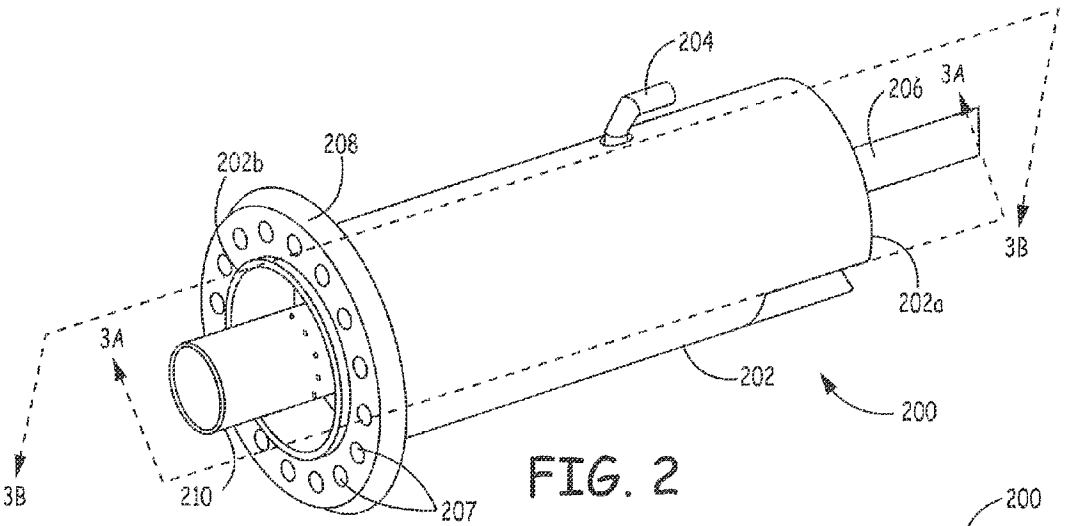
FIG. 2 is a side perspective view of a combustor of one embodiment of the present invention.
Figure 4:
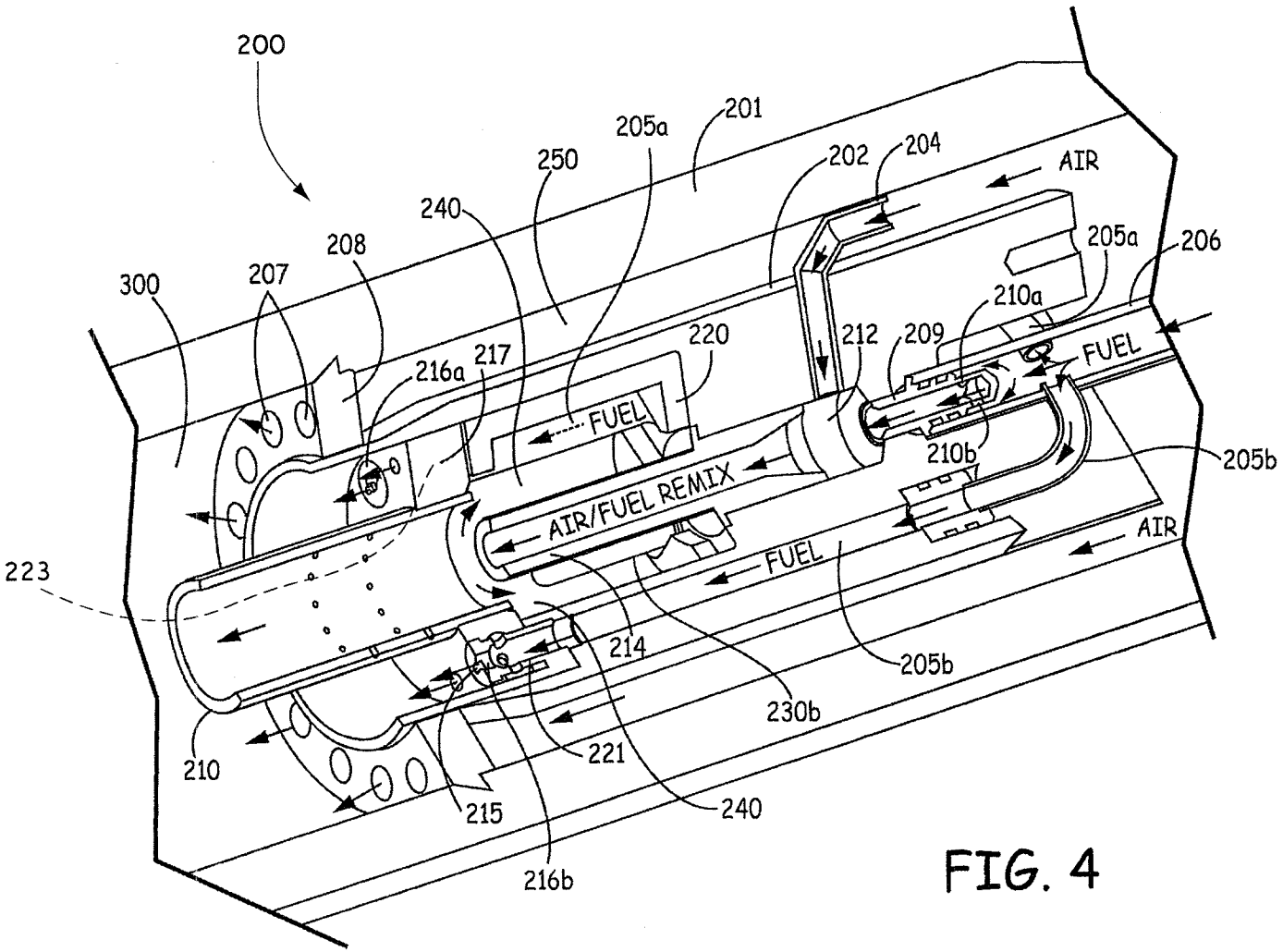
FIG. 4 is a cross-sectional side view of the combustor of FIG. 2 illustrating gas flow through the combustor.

The combustor 200 is illustrated in FIGS. 2 through 4. FIG. 2 is a side perspective view of the combustor 200, which includes an injector body 202. The injector body 202 is generally cylindrical in shape having a first end 202*a* and a second end 202*b*. A fuel inlet tube 206 enters the first end 202*a* of the injector body 202 to provide fuel to the combustor 200. As also illustrated in FIGS. 2 and 3B, a premix air inlet tube 204 passes through the injector body 202 to provide a flow of air to the combustor 200. A burner (such as, but not limited to, an air swirl plate 208) is coupled proximate the second end 202*b* of the injector body 202. The air swirl plate 208 includes a plurality of angled air passages 207, which causes air passed through the air passages 207 to flow into a vortex. Also illustrated in FIG. 2, is a jet extender 210 that extends from the second end 202*b* of the injector body 202. In particular, the tubular-shaped jet extender 210 extends from a central passage of a fuel injector plate 217 past the second end 202*b* of the injector body 202. The jet extender 210 separates a premix air/fuel flow used for an initial ignition, for a select distance, from a flow of air/fuel used in the main combustion chamber 300. An exact air/fuel ratio is needed for the initial ignition in the ignition chamber 240. The jet extender 210 prevents fuel delivered from the fuel injector plate 217 from flowing into the ignition chamber 240, therein unintentionally changing the air/fuel ratio in the ignition chamber 240. In this example of a jet extender, jet extender 210 includes a plurality of aligned rows of passages 211 through a mid-portion of the body of the jet extender 210. The plurality of aligned rows of passages 211 through the mid-portion of the body of the jet extender 210 serves to achieve a desired air/fuel ratio between the ignition chamber 240 and the main combustion chamber 300. This provides passive control of ignition at an intended air/fuel ratio of the main combustion chamber 300.

As discussed above, the jet extender 210 extends from a central passage of a fuel injector plate 217. As FIGS. 3A and 3B illustrate, the fuel injector plate 217 is generally a disk shape having a select height with a central passage. An outer surface of the fuel injector plate 217 engages an inner surface of the injector body 202 near and at a select distance from the second end 202*b* of the injector body 202. In particular, a portion of a side of the fuel injector plate 217 abuts an inner ledge 202*c* of the injector body 202 to position the fuel injector plate 217 at a desired location in relation to the second end 202*b* of the injector body 202. The fuel injector plate 217 includes internal passages 217*a* and 217*b*, which lead to fuel exit passages 215. Chokes 221 and 223 are positioned in respective openings 219*a* and 219*b* in the internal passages 217*a* and 217*b* of the injector plate 217. The chokes 221 and 223 restrict fuel flow and distribute fuel flow through respective choke fuel discharge passages 221*a* and 223*a* that exit the injector plate 217, as well as into the internal passages 217*a* and 217*b* of the injector plate 217 via a plurality of openings 221*b* and 223*b*. Fuel passed into the internal passages 217*a* and 217*b* exits out of the injector plate 217 via injector passages 215.

The fuel inlet tube 206 provides fuel to the combustor 200. In particular, as illustrated in FIG. 3A, an end of the fuel inlet tube 206 receives a portion of a premix fuel member 209. The premix fuel member 209 includes an inner cavity 209*a* that opens into a premix chamber 212. In particular, the premix fuel member 209 includes a first portion 209*b* that fits inside the fuel inlet tube 206. The first portion 209*b* of the premix fuel member 209 includes premix fuel passage inlet ports 210*a* and 210*b* to the inner cavity 209*a*. Fuel from the fuel inlet tube 206 is passed through the premix fuel passage inlet ports 210*a* and 210*b* and then into the inner cavity 209*a* to the premix chamber 212. The premix fuel member 209 further includes a second portion 209*c* that is positioned outside the fuel inlet tube 206. The second portion 209*c* of the premix fuel member 209 is coupled to the premix chamber 212. The second portion 209*c* further includes an engaging flange 209*d* that extends from a surface of the fuel inlet tube 206. The engaging flange 209*d* engages the end of fuel inlet tube 206. In one embodiment, a seal is positioned between the engaging flange 209*d* and the end of the fuel inlet tube 206. Although not shown, another end of the fuel inlet tube 206 is coupled to an internal passage in the housing 102 of the downhole combustion assembly 100 to receive fuel. As also illustrated in FIG. 3A, branch fuel delivery conduits 205*a* and 205*b*, coupled to the fuel inlet tube 206, provide a fuel flow to the respective chokes 221 and 223 in the fuel injector plate 217. As illustrated in FIG. 3B, the premix air inlet 204 provides air to the premix chamber 212. The air/fuel mix is then passed to the air/fuel premix injector 214, which distributes the fuel/air mixture into an initial ignition chamber 240. The initial ignition chamber 240 is lined with insulation 220 to minimize heat loss. The air/fuel mixture from the premix injector 214 is ignited via the one or more glow plugs 230*a* and 230*b*.

Referring to FIG. 4, a description of the operation of the combustor 200 is provided. Fuel, such as, but not limited to, methane, is delivered through passages in the housing 102 (FIG. 1) to the fuel inlet tube 206 under pressure. As illustrated, the fuel passes through the fuel inlet tube 206 into the plurality of branch fuel delivery conduits 205*a* and 205*b* and into the premix fuel passage inlet ports 210*a* and 210*b* of the premix fuel inlet member 209. Although only two branch fuel delivery conduits 205*a* and 205*b* and two premix fuel passage inlet ports 210*a* and 210*b* to the premix fuel inlet member 209 are shown, any number of fuel delivery conduits and premix fuel inlets could be used and the present invention is not limited by any number. Fuel entering the premix fuel passage inlet ports 210*a* and 210*b* of the premix fuel inlet member 209, is delivered to the premix chamber 212 where it is mixed with air from the premix air inlet 204, as discussed below. Fuel passing through the branch fuel delivery conduits 205*a* and 205*b* is delivered to the chokes 221 and 223 and out fuel injectors 216*a* and 216*b* and fuel passages 215 in the fuel injector plate 217 to provide a flow of fuel for the main combustion chamber 300.

Air under pressure is also delivered to the combustor 200 through passages in the housing 201. In this embodiment, air under pressure is in passage 250 between the injector body 202 and the housing 201. Air further passes through air passages 207 in the air swirl plate 208, therein providing an airflow for the main combustion chamber 300. As illustrated, some of the air enters the premix air inlet 204 and is delivered to the premix chamber 212. The air and the fuel mixed in the premix chamber 212 are passed to the air/fuel premix injector 214, which is configured and arranged to deliver the air/fuel mixture, so that the air/fuel mixture from the air/fuel premix injector 214 swirls around in the initial ignition chamber 240 at a relatively low velocity. The one or more glow plugs 230*a* and 230*b* heat this relatively low velocity air/fuel mixture to an auto-ignition temperature, wherein ignition occurs. The combustion in the initial ignition chamber 240 passing through the jet extender 210 ignites the air/fuel flow from the fuel injector plate 217 and the air swirl plate 208 in the main combustion chamber 300. Once combustion has been achieved in the main combustion chamber 300, power to the glow plugs 230*a* and 230*b* is discontinued. Hence, combustion in the initial ignition chamber 240 is a transient event so that the heat generated will not melt the components. The period of time the glow plugs 230*a* and 230*b* are activated to ignite the air/fuel mix in the initial ignition chamber 240 can be brief. In one embodiment, it is around 8 to 10 seconds.

In an embodiment, an air/fuel equivalence ratio in the range of 0.5 to 2.0 is achieved in the initial ignition chamber 240 via the air/fuel premix injector 214 during initial ignition. Concurrently, the air/fuel equivalence ratio in the main combustion chamber 300 is in the range of 0.04 to 0.25, achieved by the air swirl plate 208 and the fuel injector plate 217. After ignition of the flow in the initial combustion chamber 240 and the main combustion chamber 300, the glow plugs 230*a* and 230*b* are shut down. An air/fuel equivalence ratio within a range of 5.0 to 25.0 is then achieved within the initial ignition chamber 240; while concurrently, an air/fuel equivalence ratio in the range of 0.1 to 3.0 is achieved in the main combustion chamber 300, by the air swirl plate 208 and the fuel injector plate 217. This arrangement allows for a transient burst from the initial ignition chamber 240 to light the air/fuel in the main combustion chamber 300, after which any combustion in the initial ignition chamber 240 is extinguished by achieving an air/fuel equivalence ratio too fuel rich to support continuous combustion. To cease combustion in the main combustion chamber 300, either or both the air and the fuel is shut off to the combustor 200.

Although specific embodiments have been illustrated and described herein, it will be appreciated by those of ordinary skill in the art that any arrangement, which is calculated to achieve the same purpose, may be substituted for the specific embodiments shown. This application is intended to cover any adaptations or variations of the present invention. Therefore, it is manifestly intended that this invention be limited only by the claims and the equivalents thereof.

The invention claimed is:

1. A combustor comprising:

a housing having a longitudinal extent and a portion thereof forming an outer periphery of a main combustion chamber;

an injector body coupled concentrically within the housing, the housing and the injector body defining an annular air flow passage therebetween;

an initial combustion chamber within the injector body;

insulation lining the initial combustion chamber;

a tubular air/fuel premix injector within the injector body in communication with the initial combustion chamber;

a premix chamber in downstream communication with the air/fuel premix injector and in upstream communication with a fuel inlet and with an air inlet;

an igniter configured and arranged to heat the air/fuel mixture in the initial combustion chamber to an auto-ignition temperature;

a fuel injector configured and arranged to dispense fuel into the main combustion chamber and comprising an annular fuel injector plate having a central opening through which combustion in the initial combustion chamber may pass, the annular fuel injector plate having multiple circumferential openings with their central axes substantially parallel to the central axis of the burner;

a burner comprising a central opening aligned with the central opening of the annular fuel injection plate, surrounding an end of the injector body proximate the main combustion chamber and located between the housing and the injector body to dispense air from the substantially air flow passage into the main combustion chamber; and a generally tubular jet extender extending longitudinally from the central opening of the fuel injector plate through the central opening of the burner into the main combustion chamber.

2. The combustor of claim 1, wherein the burner comprises an annular air swirl plate abutting the housing and the injector body and comprising a plurality of circumferentially spaced, angled air passages.

3. The combustor of claim 1, further comprising:

a fuel inlet tube to provide a fuel to the fuel inlet; and a premix air inlet tube in communication with the premix chamber and with the annular air flow passage to provide air to the air inlet.

4. The combustor of claim 1, wherein the fuel inlet comprises a fuel inlet tube, and further comprising:

a premix fuel inlet member in communication with the fuel inlet tube and the premix chamber, the premix fuel inlet member having an inner cavity, the premix fuel inlet member having a first portion positioned within interior of the fuel inlet tube including at least one premix fuel inlet passage to the inner cavity and a second portion positioned outside the fuel inlet tube in communication with the air/fuel premix chamber.

5. The combustor of claim 4, wherein the premix chamber includes a first portion in communication with the premix fuel inlet member having a generally cylindrical shape and a second portion extending from the first portion having a generally funnel shape and in communication with the air/fuel premix injector.

6. The combustor of claim 1, wherein:

the annular fuel injector plate abuts and extends radially inwardly from an interior of the injector body, longitudinally inward of an end thereof; and further comprising at least one choke comprising a fuel discharge passage, mounted to the annular fuel injector plate and in communication with a fuel delivery conduit.

7. The combustor of claim 6, wherein the at least one choke further comprises at least one opening in communication with an internal passage in the fuel injector plate having at least one injector passage in communication with the main combustion chamber.

8. The combustor of claim 7, further comprising:

a generally tubular jet extender secured to the fuel injector plate, extending longitudinally therefrom through the burner and into the main combustion chamber.

9. The combustor of claim 1, wherein the jet extender has at least one row of circumferentially spaced aligned passages through a wall thereof in communication with an interior of the jet extender an interior of the injector body.

10. The combustor of claim 1, wherein the igniter comprises at least one glow plug.

11. A combustor comprising:

a longitudinally extending housing comprising a portion forming a main combustion chamber;

an injector body located concentrically within the housing and including an initial combustion chamber;

insulation lining the initial combustion chamber;

an air/fuel premix injector in communication with the initial combustion chamber;

at least one glow plug configured and arranged to cause ignition of an air/fuel mixture in the initial combustion chamber;

an annular fuel injector plate comprising a central opening aligned with the air/fuel premix injector, the annular fuel injector plate configured to dispense fuel into the main combustion chamber and coupled within the injector body at a longitudinal distance from an outlet of the air/fuel premix injector;

a burner comprising an annular swirl plate having a central opening aligned with the air/fuel premix injector and comprising a plurality of circumferentially spaced angled passages therethrough, the burner configured to dispense air from between the housing and the injector body into the main combustion chamber for ignition of fuel dispensed by the annular fuel injection plate into the main combustion chamber by combustion of the air/fuel premix in the initial combustion chamber; and a generally tubular jet extender extending longitudinally from the central opening of the fuel injector plate through the central opening of the swirl plate into the main combustion chamber;

wherein the jet extender separates premix air/fuel flow from air/fuel flow used in the main combustion chamber.

12. A combustor comprising:

a longitudinally extending housing comprising a main combustion chamber;

an injector body including an initial combustion chamber secured within and spaced from an interior of the housing insulation lining the initial combustion chamber;

an air/fuel premix injector assembly within the injector body comprising a premix chamber in communication with a fuel inlet tube and with a premix air inlet, the premix chamber including a first portion of a generally cylindrical shape in communication with the fuel inlet tube and the premix air inlet, and an air\fuel premix injector in communication with the premix chamber extending into and surrounded by the initial combustion chamber configured and arranged to dispense an air/fuel mixture into the initial combustion chamber, a second portion of the premix chamber of a generally funnel shape extending from the first portion in communication with the air\fuel premix injector;

at least one glow plug located and configured to cause ignition of an air/fuel mixture in the initial combustion chamber;

an annular fuel injector plate secured to an interior of the injector body a longitudinal distance from an outlet of the air/fuel premix injector assembly, the fuel injector plate positioned to dispense fuel into the initial combustion chamber and configured to dispense fuel into the main combustion chamber;

a swirl plate burner coupled around an outer surface of the injector body and extending to the interior of the housing, the swirl plate burner configured to dispense a flow of air from between the injector body and the housing to form a vortex within the main combustion chamber for ignition of the fuel dispensed by the fuel injector plate into the main combustion chamber by combustion of the air/fuel mixture in the initial combustion chamber; and a generally tubular jet extender secured to an interior of the fuel injector plate and extending longitudinally into the main combustion chamber, wherein the jet extender separates premix air/fuel flow from air/fuel flow used in the main combustion chamber.

13. The combustor of claim 12, further comprising:

a premix fuel inlet member in communication with the fuel inlet tube and the premix chamber, the premix fuel inlet member having an inner cavity and a first portion positioned within an inner passage of the fuel inlet tube, the first portion having at least one premix fuel inlet passage to the cavity of the premix fuel connecting member and a second portion in communication with the premix chamber.

14. The combustor of claim 12, further comprising:

at least one fuel delivery conduit configured and arranged to provide a flow of fuel to the fuel injector plate; and a choke carried by the fuel injector plate in communication with each fuel delivery conduit, each choke having a fuel discharge passage and at least one passage in communication with at least one internal injector plate passage in the fuel injector plate leading to a fuel injector passage to the main combustion chamber.

* * * * *